US010299580B2

(12) United States Patent
Xi et al.

(10) Patent No.: US 10,299,580 B2
(45) Date of Patent: May 28, 2019

(54) MULTI-COMPONENT BRISTLE HAVING COMPONENTS WITH DIFFERENT ORAL CARE ADDITIVES, AND ORAL CARE IMPLEMENT COMPRISING THE SAME

(71) Applicant: COLGATE-PALMOLIVE COMPANY, New York, NY (US)

(72) Inventors: Wen Jin Xi, Shanghai (CN); Ting Yan, Shanghai (CN); Bo Zhang, Yangzhou (CN); Guang Sheng Guo, Yangzhou (CN)

(73) Assignee: Colgate-Palmolive Company, New York, NY (US)

( * ) Notice: Subject to any disclaimer, the term of this patent is extended or adjusted under 35 U.S.C. 154(b) by 416 days.

(21) Appl. No.: 15/102,817

(22) PCT Filed: Dec. 12, 2013

(86) PCT No.: PCT/CN2013/089206
§ 371 (c)(1),
(2) Date: Jun. 8, 2016

(87) PCT Pub. No.: WO2015/085536
PCT Pub. Date: Jun. 18, 2015

(65) Prior Publication Data

US 2017/0020278 A1 Jan. 26, 2017

(51) Int. Cl.

| | |
|---|---|
| ***A46D 1/00*** | (2006.01) |
| ***A46B 9/04*** | (2006.01) |
| ***A46B 11/00*** | (2006.01) |

(52) U.S. Cl.
CPC ..... *A46D 1/023* (2013.01); *A46B 9/04* (2013.01); *A46D 1/0276* (2013.01); (Continued)

(58) Field of Classification Search
CPC .... A46D 1/023; A46D 1/0276; A46D 1/0284; A46B 9/04; A46B 2200/1066
See application file for complete search history.

(56) References Cited

U.S. PATENT DOCUMENTS

| | | | |
|---|---|---|---|
| 4,263,691 A | 4/1981 | Pakarnseree | |
| 5,533,227 A | 7/1996 | Ito et al. | |

(Continued)

FOREIGN PATENT DOCUMENTS

| | | | |
|---|---|---|---|
| CN | 201409610 | 2/2010 | |
| GB | 2323026 A * | 9/1998 | ..... A46B 15/001 |

(Continued)

OTHER PUBLICATIONS

Computer generated English translation of JP 2005-000310 A, Kobayashi, Jan. 2005.*

(Continued)

*Primary Examiner* — Laura C Guidotti

(57) ABSTRACT

An oral care implement (100) including at least multi-component bristle. The oral care implement (100) comprises a handle (120); a head (110) coupled to the handle (120); at least one bristle tuft extending from the head, the at least one bristle tuft comprises at least one multi-component bristle (200) comprising coextruded core (210) and sheath components (220), the sheath component (220) surrounding a first portion (215) of the core component (210), and a second portion (216) of the core component (210) protruding from the sheath component (220) at a tip portion (230) of the multi-component bristle (200); the sheath component (220) comprises a first plastic and a first oral care additive; the core component (210) comprises a second plastic and a second oral care additive, wherein the first oral care additive is different than the second oral care additive.

20 Claims, 12 Drawing Sheets

(52) U.S. Cl.
CPC ..... *A46D 1/0284* (2013.01); *A46B 11/0072* (2013.01); *A46B 2200/1066* (2013.01)

(56) References Cited

U.S. PATENT DOCUMENTS

| | | | |
|---|---|---|---|
| 5,836,769 | A | 11/1998 | Spencer |
| 5,985,192 | A | 11/1999 | Weihrauch |
| D423,787 | S | 5/2000 | Musciano |
| 6,058,541 | A | 5/2000 | Masterman et al. |
| 6,079,087 | A | 6/2000 | Cansler |
| 6,141,819 | A | 11/2000 | Driesen et al. |
| 6,280,113 | B1 | 8/2001 | Gueret |
| 6,390,708 | B1 | 5/2002 | Gueret |
| D501,999 | S | 2/2005 | Hellmann |
| 6,871,373 | B2 | 3/2005 | Driesen et al. |
| 7,134,162 | B2 | 11/2006 | Kweon et al. |
| D610,810 | S | 3/2010 | Evans |
| D627,972 | S | 11/2010 | Evans |
| D627,973 | S | 11/2010 | Evans |
| D628,806 | S | 12/2010 | Van der Lande |
| D634,934 | S | 3/2011 | Kalbfeld et al. |
| 8,297,710 | B2 | 10/2012 | Sakurai et al. |
| 2009/0094770 | A1 | 4/2009 | Zoschke et al. |
| 2011/0138559 | A1 | 6/2011 | Plotka et al. |
| 2011/0232014 | A1 | 9/2011 | Uchida et al. |
| 2011/0308026 | A1 | 12/2011 | Jimenez et al. |
| 2012/0174331 | A1 | 7/2012 | Kwon et al. |
| 2012/0233791 | A1 | 9/2012 | Uchida et al. |
| 2012/0301210 | A1 | 11/2012 | Sturgis et al. |
| 2015/0257525 | A1* | 9/2015 | Kang ..... A46D 1/0207 15/167.1 |

FOREIGN PATENT DOCUMENTS

| | | |
|---|---|---|
| JP | H04-112632 | 4/1992 |
| JP | 2005-000310 A | 1/2005 |
| JP | 2011200352 | 10/2011 |
| TW | 201236601 | 9/2012 |
| TW | 201412269 A | 4/2014 |
| WO | WO 1998/20774 | 5/1998 |
| WO | WO 2007/104381 | 9/2007 |
| WO | 2013/066070 | 5/2013 |
| WO | WO 2013/084863 | 6/2013 |

OTHER PUBLICATIONS

International Search Report and the Written Opinion issued in International Patent Application PCT/CN2013/089206 dated Sep. 19, 2014.

Yangzhou Jimxia Plastic Products & Rubber Col, Ltd., http://cnixsi.en.alibaba.com/product/620430647- 200912796/Anti_bacterial_filaments_Tapered_Spiral_filaments_Latest_toothbrush.html, downloaded from the Internet prior to the date of the application.

* cited by examiner

MULTI-COMPONENT BRISTLE HAVING COMPONENTS WITH DIFFERENT ORAL CARE ADDITIVES, AND ORAL CARE IMPLEMENT COMPRISING THE SAME

BACKGROUND

Toothbrushes are typically used by applying toothpaste or dentifrice to a bristle section on the head of the toothbrush, followed by brushing regions of the oral cavity (e.g., the teeth or soft tissue such as the tongue and/or gums) with the bristle section. Some toothbrushes have been equipped with internal reservoirs and systems for delivering dentifrice to a user's oral cavity. Other toothbrushes have been developed that include dentifrice that is pre-coated onto the bristles. However, in known toothbrushes only dentifrice or a single oral care additive is available for application to a user's oral cavity. Thus, a need exists for a toothbrush having multiple different oral care additives for application to a user's oral cavity.

BRIEF SUMMARY

Exemplary embodiments according to the present disclosure are directed to oral care implements that have at least one multi-component bristle extending from the head thereof. The multi-component bristle is formed by a core component and a sheath component surrounding at least a portion of the core component. In one embodiment, each of the core and sheath components comprises a different oral care additive. In another embodiment, only one of the core and sheath components comprises an oral care additive. In yet another embodiment, each of the core and sheath components comprises the same oral care additive.

In one aspect, the invention can be an oral care implement comprising a handle; a head coupled to the handle; at least one bristle tuft extending from the head, the at least one bristle tuft comprising at least one multi-component bristle comprising coextruded core and sheath components, the sheath component surrounding a first portion of the core component, and a second portion of the core component protruding from the sheath component at a tip portion of the multi-component bristle; the sheath component comprising a first plastic and a first oral care additive; the core component comprising a second plastic and a second oral can additive, wherein the first oral care additive is different than the second oral care additive.

In another aspect, the invention can be an oral care implement comprising: a handle; a head coupled to the handle; at least one bristle tuft extending from the head, the at least one bristle tuft comprising at least one multi-component bristle comprising coextruded core and sheath components, the sheath component surrounding a first portion of the core component, and a second portion of the core component protruding from the sheath component at a tip portion of the multi-component bristle; the sheath component comprising a first plastic; the core component comprising a second plastic; and wherein one of the core and sheath components comprises an oral care additive and the other one of the core and sheath components is free of an oral care additive.

In yet another embodiment, the invention can be a multi-component bristle comprising: a core component, a sheath component, the sheath component surrounding a first portion of the core component, and a second portion of the core component protruding from the sheath component at a tip portion of the multi-component bristle; the sheath component comprising a first plastic and a first oral care additive; and the core component comprising a second plastic and a second oral care additive, wherein the first oral care additive is different than the second oral care additive.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
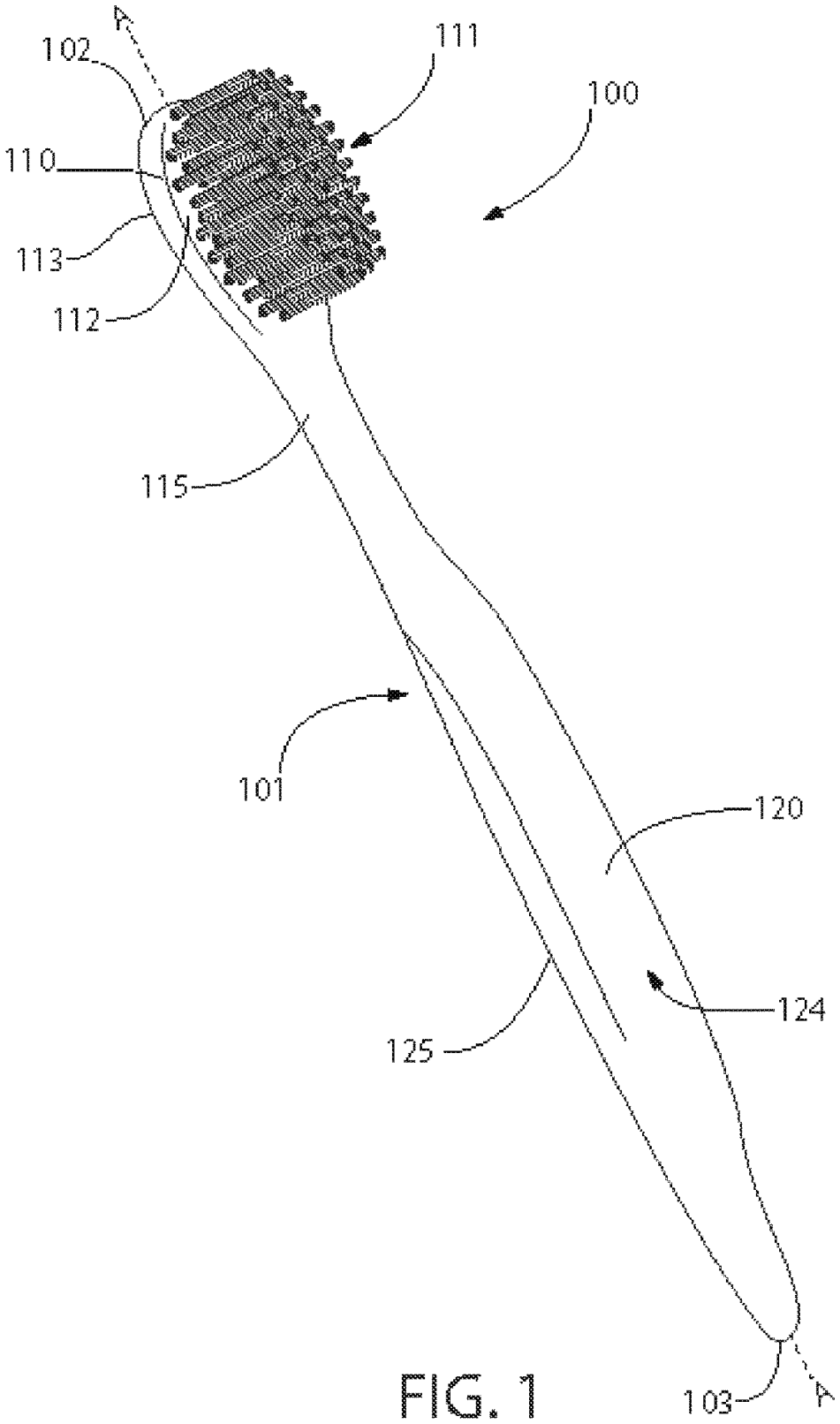
FIG. 1 is a front perspective view of an oral care implement having multi-component bristles according to an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally" "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIG. 1, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement extends from a proximal end 103 to a distal end 102 along a longitudinal axis A-A. The oral care implement 100 generally includes an elongated body 101 comprising a head 110, a neck 115 and a handle 120. The handle 120 is an elongated structure that provides the mechanism by which the user can hold and manipulate the oral care implement 100 during use. The handle 120 comprises a front surface 124 and an opposing rear surface 125. In the exemplified embodiment, the handle 120 is generically depicted having various contours for user comfort. More specifically in the exemplified embodiment the handle 120 is bulbous shaped and has a larger diameter in a central region than near the proximal end 103 and neck 115. Specifically a region of the handle 120 that would normally be gripped by a user's thumb has a width that is greater than a width of the neck 115. Of course, the invention is not to be so limited in all embodiments and in certain other embodiments the handle 120 can take on a wide variety of shapes, contours and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds and polyester such as polyethylene terephthalate. Of course, the invention is not to be so limited in all embodiments and the handle 120 may include a resilient material, such as a thermoplastic elastomer, as a grip cover that is molded over portions of or the entirety of the handle 120 to enhance the gripability of the handle 120 during use. For example, portions of the handle 120 that are typically gripped by a user's palm during use may be overmolded with a thermoplastic elastomer or other resilient material to further increase comfort to a user.

The head 110 of the oral care implement 100 is coupled to the handle 120 and comprises a front surface 112 and an opposing rear surface 113. In the exemplified embodiment the head 110 is formed integrally with the handle 120 as a single unitary structure using a molding, milling, machining or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners.

In the exemplified embodiment, the head 110 of the oral care implement 100 is provided with a plurality of tooth cleaning elements 111 extending from the font surface 112. Although in the exemplified embodiment all of the both cleaning elements 111 appear to be the same, the invention is not to be so limited in all embodiments. For example, in certain embodiments the tooth cleaning elements 111 include at least one bristle tuft comprising at least one multi-component bristle comprising a core component and a sheath component. The details of various structural forms for a multi-component bristle will be described in more detail below with reference to FIGS. 2-5.

A bristle tuft is a collection of bristles that are positioned together into a single tuft hole formed on the head 110. Each bristle tuft may include, for example without limitation, only multi-component bristles, a combination of multi-component bristles and single-component (i.e., traditional) bristles, or only single-component bristles. In certain embodiments, the oral case implement 100 may include one or more bristle tufts that include exactly one multi-component bristle and a plurality of single-component bristles or one or more bristle tufts that include only multi-component bristles. In still other embodiments, the tooth cleaning elements 111 may all be formed as bristle tufts that am formed solely of multi-component bristles. Furthermore, in some embodiments the both cleaning elements 111 may include some bristle tufts that axe formed solely of single-component bristles and some bristle tufts that are formed solely of multi-component bristles, and the single-component bristle tufts and multi-component bristle tuft may be positioned on the head 110 of the oral care implement 100 in an alternating or non-alternating fashion (i.e., alternating or non-alternating transverse rows of bristle tufts alternating or non-alternating longitudinal rows of bristles, or even alternating or non-alternating tufts in each row).

Other than including at least one bristle tuft comprising at least one multi-component bristle, the exact structure, pattern, orientation and material of the remainder of the tooth cleaning elements 111 is not to be limiting of the present invention unless so specified in the claims. Thus, as used herein, the term "both cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elestomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 111 of the present invention can be connected to the head 110 in any manner known in the art. For example, staples/anchors, in-mold tufting (IMT) or anchor flee tufting (AFT) could be used to mount the cleaning elements/tooth engaging elements. In certain embodiments, the invention can be practiced with various combinations of stapled, IMT or AFT bristles. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

In the exemplified embodiment, the head 110 of the oral care implement 100 comprises a plurality of tuft holes (not visible) formed therein. A plurality of tufts of bristles are positioned within and affixed to the head 110 within each of the tuft holes. Each of the tufts of bristles includes a plurality of bristles, which can be single strand bristles, double strand multi-component bristles, triple strand multi-component bristles, etc. or various combinations thereof. Thus, one tuft of bristles may include one double strand multi-component bristle and a plurality of single strand bristles or only double strand multi-component bristles or only triple strand multi-component bristles or a combination of single strand bristles, double strand multi-component bristles and triple strand multi-component bristles. Additionally, a single tuft hole may be filled with an elastomeric cleaning element or any of the other types of cleaning elements noted above. As noted above, in one embodiment at least one bristle tuft includes at least one multi-component bristle, which may be a double, triple or otherwise strand multi-component bristle. The details of the multi-component bristles will be discussed in more detail below with reference to FIGS. 2-5.

Although not illustrated herein, in certain embodiments the head 110 may also include a soft tissue cleanser coupled to or positioned on its rear surface 113. An example of a suitable soft tissue cleanser that may be used with the present invention and positioned on the rear surface of the head 110 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

Figure 2A:
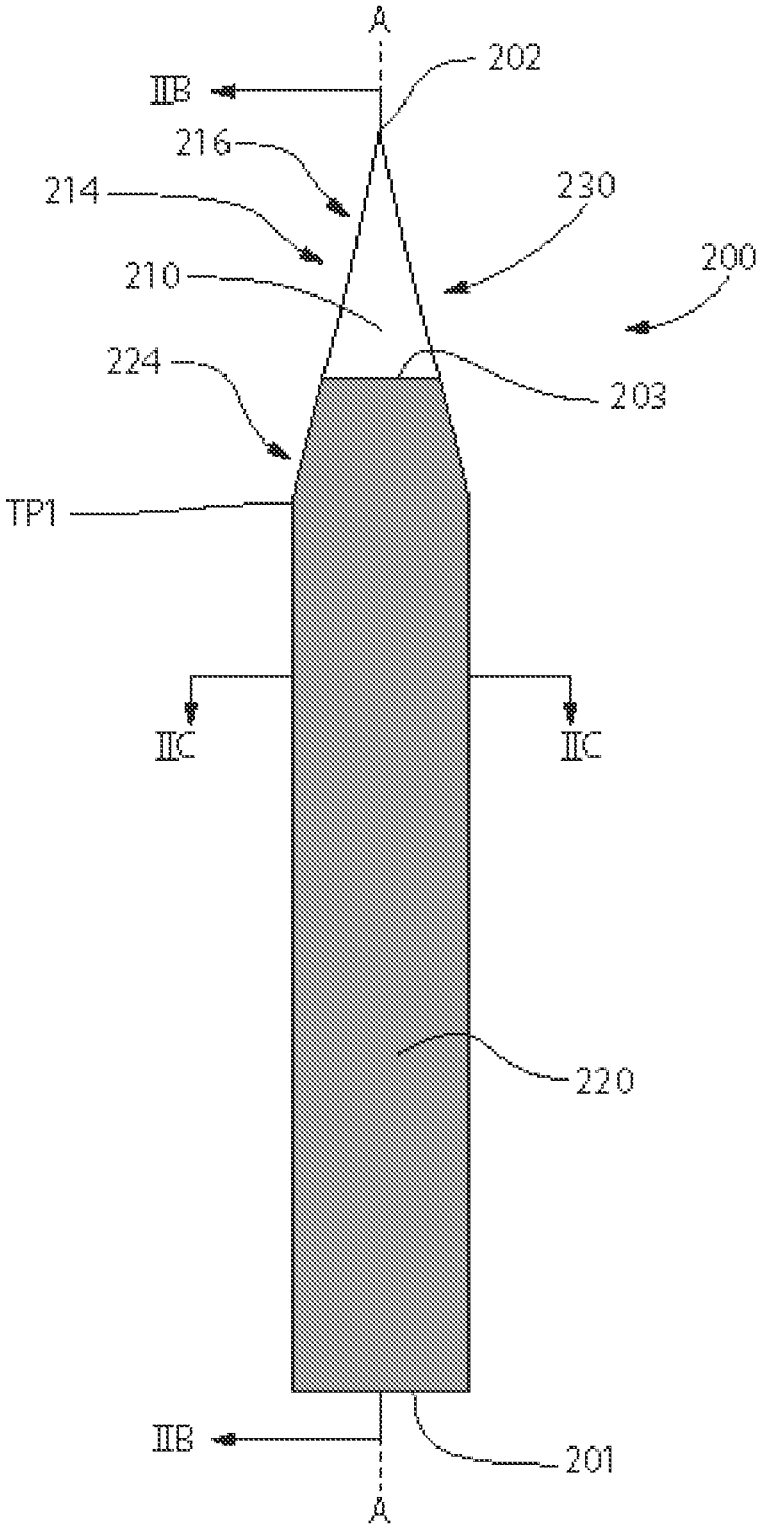
FIG. 2A is a front perspective view of a multi-component bristle in accordance with a first embodiment of the present invention.
Figure 2B:
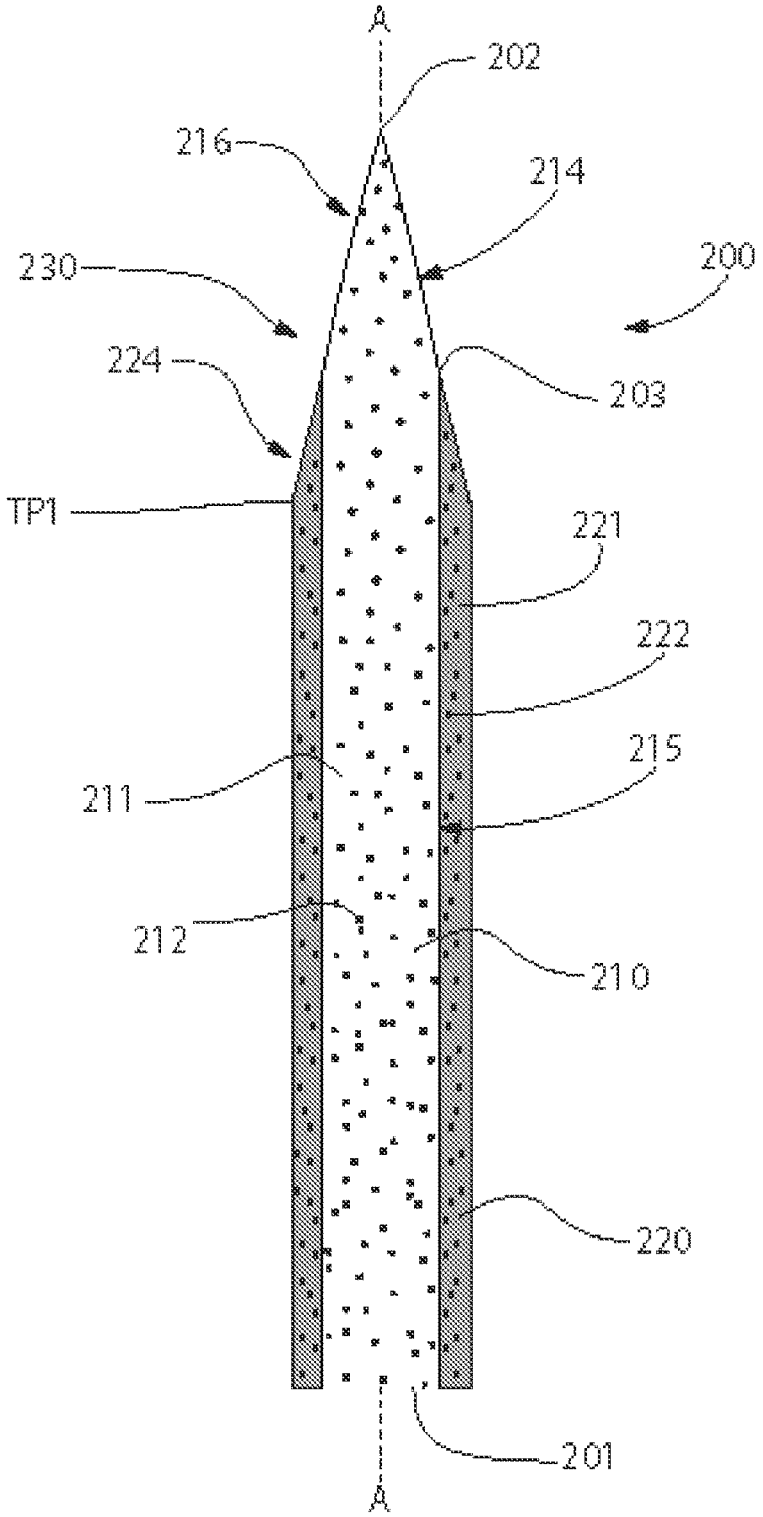
FIG. 2B is a cross-sectional view taken along line IIB-IIB in FIG. 2A.
Figure 2C:
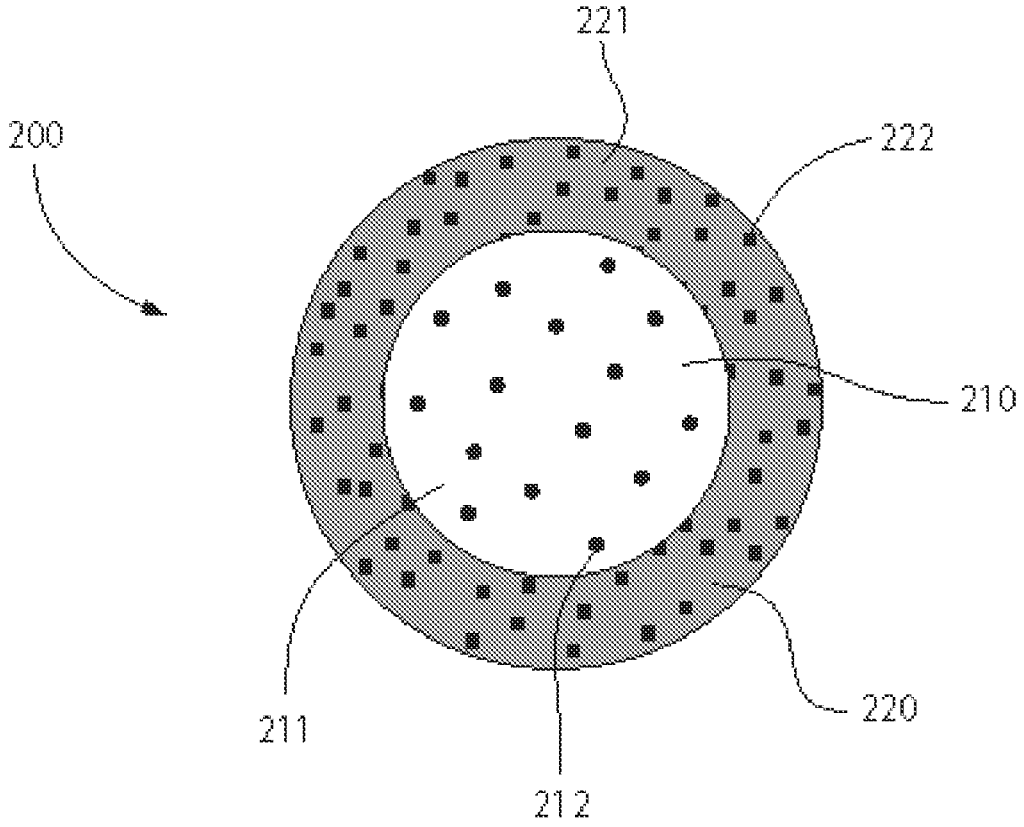
FIG. 2C is a cross-sectional view taken along line IIC-IIC in FIG. 2A.

Referring now to FIGS. 2A-2C concurrently, a multi-component bristle 200 is illustrated in accordance with an embodiment of the present invention. The multi-component bristle 200 extends from a base end 201 to a free end 202 along a longitudinal axis A-A. The multi-component bristle 200 comprises a core component 210 and a sheath component 220 that are coextruded to form the multi-component bristle 200. Stated another way the multi-component bristle 200 comprises the coextruded corn and sheath components 210, 220. In the exemplified embodiment, the sheath component 220 surrounds a first portion 215 of the core component 210 and a second portion 216 of the core component 210 protrudes from the sheath component 220 at a tip portion 230 of the multi-component bristle 200. The second portion 216 of the core component 210 is therefore exposed whereas the first portion 215 of the core component 210 is rot exposed. Thus, at least a portion of each of the core and sheath components 210, 220 is visible from an exterior of the multi-component bristle 200, and more specifically an entirety of the sheath component 220 is visible and the second portion 216 of the core component 210 is visible from the exterior of the multi-component bristle 200.

In the exemplified embodiment, each of the core and sheath components 210, 220 extend all the way to the base end 201 of the multi-component bristle 200. The core component 210 extends from the base end 201 of the multi-component bristle 200 to the flee end 202 of the multi-component bristle 200. The sheath component 220 extends from the base end 201 of the multi-component bristle 200 to a terminal end 203 of the sheath component 220. In the exemplified embodiment the second portion 216 of the core component 210 makes up between approximately 15-20% of the total length of the multi-component bristle 200, more specifically between approximately 17-23% of the total length of the multi-component bristle 200, and even mom specifically between approximately 20-22% of the total length of the multi-component bristle 200. In another embodiment, the exposed second portion 216 of the core component 210 may make up between approximately 10-15%, and more specifically between approximately 12-13% of the total length of the multi-component bristle 200. Furthermore, the sheath component 220 extends approximately 75-80% of the total length of the multi-component bristle 200, more specifically approximately 77-83% of the total length of the multi-component bristle 200, and even more specifically between approximately 78-80% of the total length of the multi-component bristle 200, or between approximately 85-90% or 87-88% of the total length of the multi-component bristle 200.

In the exemplified embodiment, the multi-component bristle 200 has a cylindrical cross-sectional shape. Furthermore, the core component 210 has a cylindrical cross-sectional shape and the sheath component 220 has a ring-like shape that circumferentially and concentrically surrounds the core component 210 for at least part of the length of the core component 210. Of course, the invention is not to be so limited and the core component 210 can take on other polygonal shapes as desired and the shape of the sheath component 220 can likewise change so long as the sheath component 220 circumferentially surrounds the core component 210 for at least a portion of the length of the core component 210.

Due to the nature of multi-component bristle formation in that two or more components are coextruded to form the multi-component bristle 200, these components can be used to house, store or otherwise contain oral care additives including oral care agents. Specifically, each of the core and sheath components 210, 220 can house the same oral care additive, a different oral can additive, or only one of the two or more components that forms the multi-component bristle 200 can contain an oral can additive while the other of the two or more components may be devoid of an oral care additive. Thus, in certain embodiments two or more oral care additives can be housed separately on different components (i.e., core and sheath components) of a single multi-component bristle and can be made to intermix during use of the multi-component bristle (or oral care implement on which the multi-component bristle is disposed). Intermixing of two or more oral care additives can be beneficial so that a chemical reaction occurs within a use r's oral cavity and so that in some circumstances a third oral care additive or agent can be formed by the reaction of the first and second oral care additives within the use user's oral cavity.

Referring still to FIGS. 2A-2C, in certain embodiments the core component 210 comprises a first plastic 211 and a first oral care additive 212 and the sheath component 220 comprises a second plastic 221 and a second oral care additive 222, the second oral care additive 222 being different than the first oral care additive 221. In the exemplified embodiment, the oral care additive 212 in the core component 210 is illustrated as round dots and the oral care additive 222 in the sheath component 220 is illustrated as square dots to schematically illustrate that each of the core and sheath components 210, 220 contains a different oral care additive. Although described herein as the core and sheath components 210, 220 having different oral care additives, in certain embodiments each of the core and sheath components 210, 220 may have the same oral care additive, or one of the core and sheath components 210, 220 may be devoid of an oral care additive while the other of the core and sheath components 210, 220 has an oral care additive.

Figure 5A:
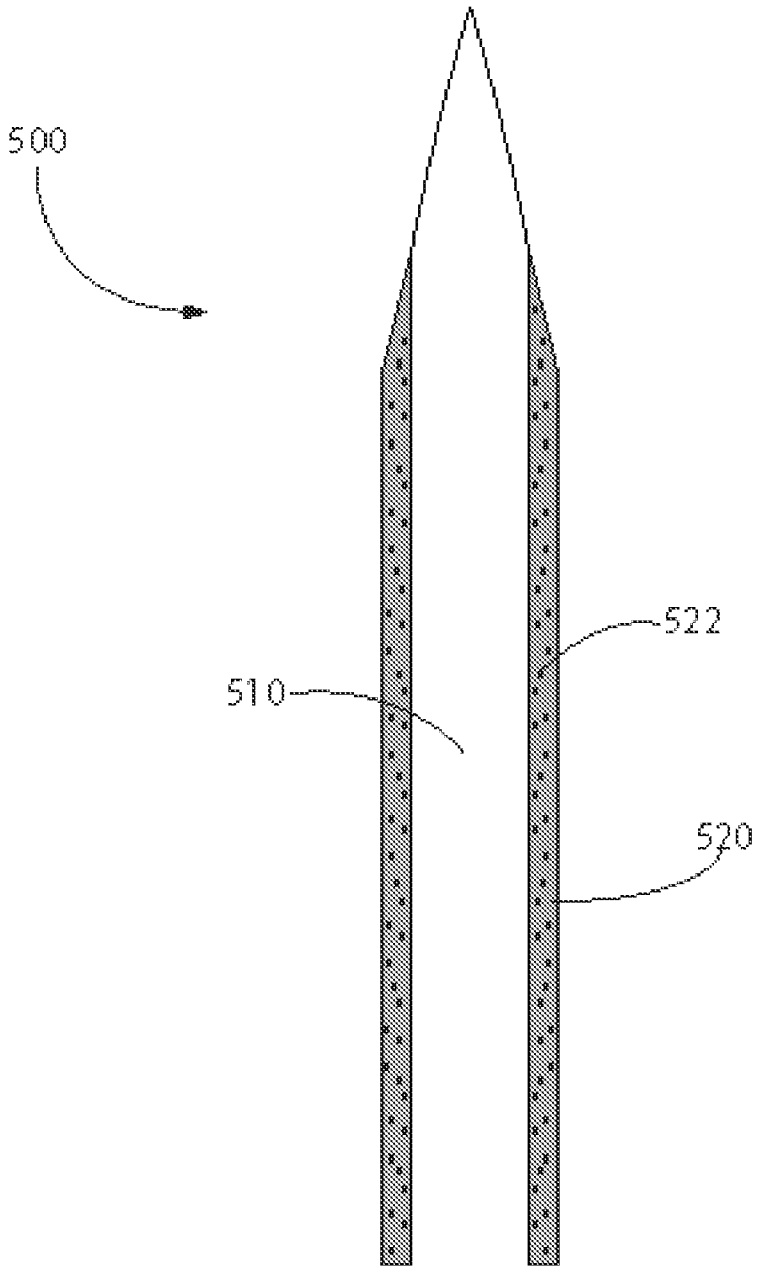
FIG. 5A is a first alternative embodiment of FIG. 2B.
Figure 5B:
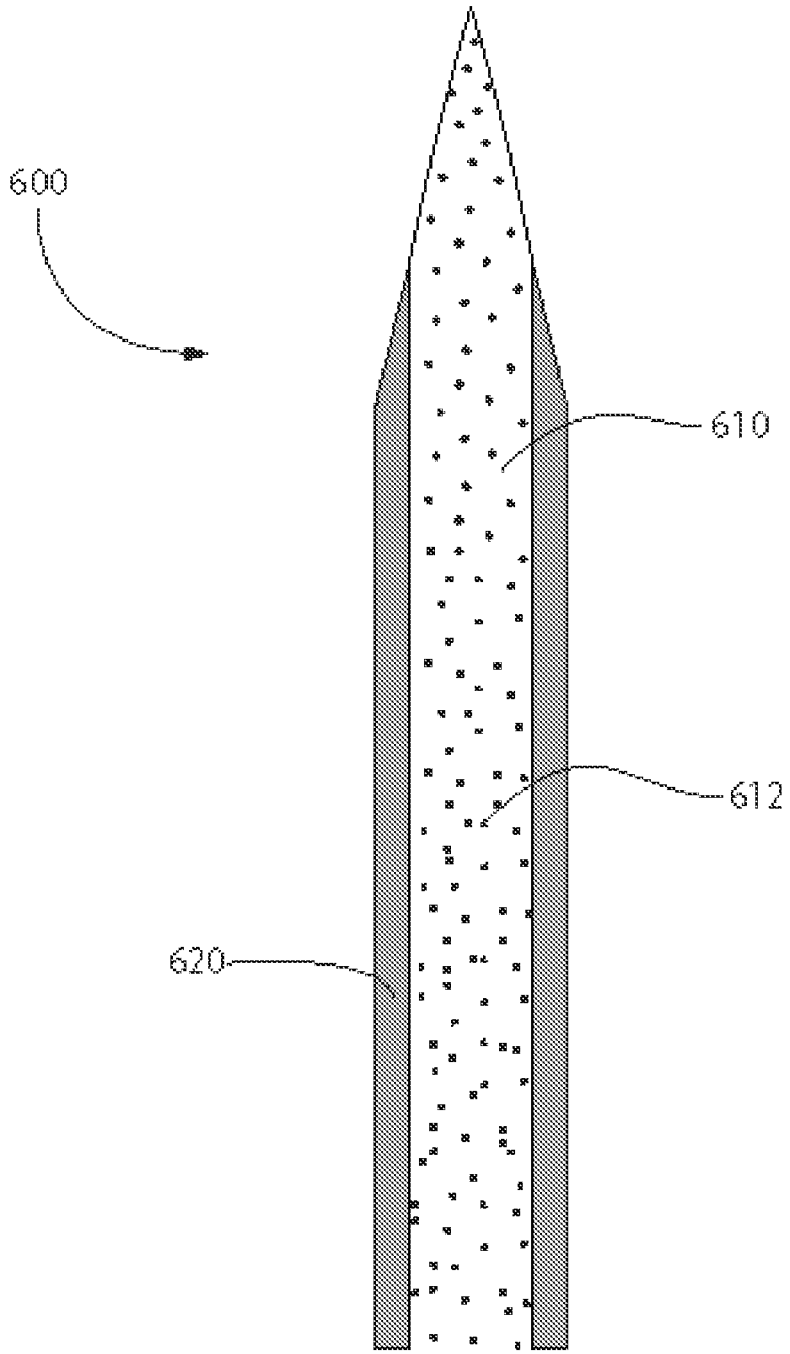
FIG. 5B is a second alternative embodiment of FIG. 2B.

Specifically referring briefly to FIG. 5A, a longitudinal cross-sectional view of a multi-component bristle 500 is illustrated that comprises a core component 510 and a sheath component 520. In this embodiment, the core component 510 is devoid or free of an oral care additive and the sheath component 520 comprises an oral care additive 522. Furthermore, referring briefly to FIG. 5B, a longitudinal cross-sectional view of a multi-component bristle 600 is illustrated that comprises a core component 610 and a sheath component 620. In this embodiment, the care component 610 comprises an oral care additive 612 and the sheath component 620 is devoid or flee of an oral care additive.

Referring back to FIGS. 2A-2C, in certain embodiments forming the core component 210 is achieved by melting the first plastic 211 and dispersing particles of the first oral care additive 212 within the melted first plastic 211. The particles of the first oral care additive 212 are thereby mixed into the first plastic 211 so that the core component 210, when formed, will contain the first oral care additive 212. Similarly, forming the sheath component 220 is achieved by melting the second plastic 221 and dispersing particles of the second oral care additive 222 within the melted second plastic 221. The particles of the second oral care additive 222 are thereby mixed into the second plastic 221 so that the sheath component 220, when formed, will contain the second oral care additive 222. As noted above, the first and second oral care additives 212, 222 can be the same or different.

Upon cooling, the first and second melted plastics 211, 221 will become hardened and the first and second oral care additives 212, 222 will be housed, contained or dispersed within the respective first and second plastics 211, 221. Next, in certain embodiments the first and second plastics 211, 221 can be coextruded to form the multi-component bristle 200 from the core and sheath components 210, 220. Alternatively the first plastic 211 with the first oral care additive 212 therein can be formed into the core component 210 and the second plastic 221 with the second oral care additive 222 therein can be separately formed into the sheath component 220 (either by separate extrusion processes or any other bristle strand forming process now known or later developed), and then the core and sheath components 210, 220 can be coupled together to form the multi-component bristle 200. In either case, the multi-component bristle 200 is formed from the core and sheath components 210, 220, each of which contains a different (or the same) oral care additive or agent therein. Of course, as noted above, one of the core and sheath components 210, 220 may be formed without dispersing an oral care additive therein if desired.

In other embodiments, the oral care additives need not be applied to the melted plastics in particle form. Rather, in certain embodiments the oral care additives 212, 222 can be added to the respective core and sheath components 210, 220 by forming the core and sheath components 210, 220 with a tactile or sticky texture to hold the oral care additives 212, 222 thereon, or by forming the core and sheath components 210, 220 with grooves, ledges, holes, hollows or other features and/or surface structure, shape or configuration that facilitates the housing of a powder, liquid, gel, paste or other form of oral care additive. In such embodiments, the oral care additive can be attached to or otherwise interspersed within the core and sheath components 210, 220 after formation thereof. Regardless of the manner of forming the multi-component bristle 200 with oral care additives therein, the oral care additives 212, 222 are releasable from the first and second plastics 211, 222 and from the core and sheath components 210, 220 of the multi-component bristle 200, particularly during use of the oral care implement 100 as will be described in more detail below, in order to provide oral health benefits to a user.

Furthermore, in certain embodiments the oral care additives, in any form (i.e., particle, powder, liquid, gel, paste etc.), may be embedded or housed within or otherwise carried by one or more carries which an then formed into, housed or contained within the core and sheath components 210, 220. Specifically the first oral care additive 212 may be carried by a first carrier and the second oral care additive 222 may be carried by a second carrier. In one embodiment, each of the first and second carriers may be one or more water-soluble polymers. In such an embodiment, the oral care additives 212, 222 may be carried by disposed within or embedded within the one or more water-soluble polymers, and then the water-soluble polymers can be added to the melted plastic that is used to form the core and sheath components 210, 220 as described above. In this manner, the carriers will be mixed or formed into the plastic material that forms the core and sheath components 210, 220, the carries carrying the oral care additives. In such embodiments, it may be desirable for the first carrier to have a higher melting point than the melting point of the first plastic 211 and for the second carrier to have a higher melting point than the melting point of the second plastic 221 so that the carrier or water-soluble polymer maintains its structure and retains the oral care additive therein when being added to the melted plastic. As the plastic cools and hardens, the carriers may then be contained or dispersed within the plastic as the plastic is formed into the core and sheath components 210, 220.

In certain embodiments, an outer surface of the carriers may blend with the plastic material of the core and/or sheath components 210, 220 to ensure that the carriers are maintained on the multi-component bristle 200 until use. Specifically, an outer surface of the carriers may partially melt along with the plastic so that when the plastic hardens, the carrier hardens along with it and the plastic and the carries be come at least partially integrally coupled together.

In certain embodiments, each of the first and second carriers can comprise one or more degradable or dissolvable capsules that carry, contain or encapsulate the first and second oral care additives 212, 222 therein. The capsules may be soluble in liquid, such as saliva, to release the oral care additives 212, 222 contained therein during use of the oral care implement 100. Stated another way the capsules degrade when subjected to moisture and thus dissolve when mixed with the saliva of the user to release its contents. Alternatively the capsules may have frangible, thin walls that break, rupture or burst to release the oral care additives 212, 222 contained therein during use due to being contacted by or rubbed against the user's teeth. In other embodiments, each of the first and second carriers can comprise one or more matrices that carry the first and second oral care additives 212, 222. Similar to the capsules, the matrices may also dissolve or break to release the oral care additives 212, 222 contained therein during use of the oral care implement 100. In other embodiments, on of the first and second carriers can comprise on or more capsules carrying the first oral care additive and the other of the first and second carriers can comprise one or more matrices carrying the second oral care additive, or each of the first and second carriers may comprise a combination of capsules and matrices that carry the respective oral care additives.

Using the carriers to house the oral care additives may assist in ensuring that the oral care additives are properly retained on the core and sheath components 210, 220 and released into a user's oral cavity during use of the oral care implement 100. Specifically, in embodiments wherein the carriers are water-soluble polymers, such carrier/water-soluble polymers will degrade, shrink or dissolve in the user's saliva during use of the oral care implement, thereby releasing the oral care additives from the carriers and into a user's oral cavity. The solubility of such water-soluble polymers can be selected as desired to create a multi-component bristle having immediate release of all of the oral car additives contained therein or a timed release of the oral car additives contained therein.

In certain embodiments the first and/or second carriers may be formed for timed or slow release of the oral car additives contained therein so that the benefits of the oral cam additives can be obtained by the user over many uses of the oral care implement 100. In one embodiment, the carriers may degrade over a period of three months so that upon the entire oral care additive having been released into the user's oral cavity during brushing, the user will know that it is time to replace the toothbrush. In certain embodiments, the core and sheath components 210, 220 of the multi-component bristle 200 may change color upon the oral can additive contained therein being depleted to visually communicate to a user that toothbrush replacement is needed. Thus, the multi-component bristles 200 can serve as both oral care additive containment/dispensing structures and as a wear indicator.

In other embodiments, the core component 210 may include first carriers (i.e., water-soluble polymers) that degrade or dissolve within a first temporal period of time and the sheath component 220 may include second carriers (water-soluble polymers) that degrade or dissolve within a second temporal period of time so that the oral care additives within the second carriers do not begin to be released until the entirety of the oral care additives within the first carriers have been released. Thus, the second carriers will not begin to dissolve until the entirety of the first carriers has dissolved, such that the first carriers will have a higher solubility than the second carriers. In other embodiments, the first and/or second carriers may completely erode, degrade, shrink or dissolve during a first use so that the entirety of the oral care additives contained therein is released into the user's oral cavity during a single use. In such embodiments, the oral can implement 100 may be a disposable or single use toothbrush.

The first and second oral care additives 211, 221 can be any of a variety of oral care additives that provide proven benefits to a user's oral health. Such oral care additives include, without limitation, lotus seed; lotus flower, bamboo salt, jasmine; corn mint; *camellia*; aloe; gingko; tea tree oil; xylitol; sea salt; vitamin C; ginger; cactus; baking soda; pine tree salt; green tea; white pearl; black pearl; charcoal powder; nephrite or jade and Ag/Au+. The lotus seed is the extract from lotus seeds and is a natural herb for anti-heating and the prevention of gum bleeding. The lotus flower is the extract from the lotus flower and is a natural herb for anti-heating and the prevention of gum bleeding. Bamboo salt is the combination of a bamboo extract and salt and is used to diminish inflammation and has anti-bacterial effects. Jasmine is an extract from the jasmine flower and is a natural herb for anti-heating, preventing gum bleeding and for mouth freshening. Corn mint is an extract from a corn mint leaf and is a natural herb for anti-heating, anti-bacterial uses and mouth freshening. *Camellia* is an extract from the *camellia* flower and is a natural herb for anti-heating and the prevention of gun bleeding. Aloe is an extract from the aloe leaf and is a natural herb for inflammation reduction and has anti-bacterial effects. Gingko is an extract from the gingko leaf and is a natural herb for inflammation reduction and has anti-bacterial effects. Tea tree oil is an extract from a tea tree and is a natural herb for diminishing inflammation and has anti-bacterial effects. Xylitol is an extract from plants such as corn, sugar cane, oak, birch, etc. and can be used for preventing tooth decay. Sea salt is an extract from the sea and can be used to reduce inflammation and has anti-bacterial effects. Vitamin C is an extract from food and can be used to prevent gum bleeding and as an antioxidant. Ginger is an extract from ginger and is a natural plant for diminishing inflammation and has anti-bacterial effects. Cactus is an extract from a cactus and it a natural plant for reducing inflammation and can be used as an antioxidant. Backing soda is a chemistry product and can be used as an enamel protectant. Pine tree salt is a mixture of the extract from pine trees and salt and is an ancient Chinese medicine for preventing inflammation and anti-heating. Green tea is an extract from the green lea leaf and is a natural herb to prevent halitosis and inhibit bacteria growth. White pearl is a kind of pearl powder and can be used for teeth whitening and teeth health improvement by calcium absorption. Black pearl is a kind of pearl powder that can be used for teeth whitening, cleaning and stain removal. Charcoal is made from an oak tree by carbonization and it helps to for moisture adjustment and to reduce the growth of bacteria. Nephrite (jade) is a kind of nephrite powder and can be used to prevent gum disease and boost the blood circulation of the gums. Ag/Au is an anti-bacterial additive contained in the Ag/Au ion (i.e., silver/gold) and can be used to inhibit bacterial growth. In certain embodiments, each of the first and second oral care additives an selected from a group consisting of a mixture of pine tree extract and salt, a tea leaf extract a pearl powder, a nephrite powder, a charcoal powder, and an antibacterial material. In some embodiments, the oral care additives are natural ingredients. In one specific embodiment the oral can additive is charcoal, particularly in the embodiments of FIGS. 5A and 5B wherein on of the core and/or sheath components 210, 220 is free of an oral can additive.

In certain embodiments, each of the core and sheath components 210, 220 may have a different color to provide both a visual aesthetic and to communicate information about the oral care additive contained on that particular component to a user. In the exemplified embodiment, the core component 210 is illustrated as being white in color and the sheath component 220 is illustrated as being gray in color. The white and gray colors are merely used to indicate that each of the core and sheath components 210, 220 can be a different color, but are not intended to indicate a specific color. In certain embodiments, the core component 210 can be any color (e.g., white, red, blue, green, yellow, orange, et.) and the sheath component 220 can also be any color (e.g., white, red, blue, green, yellow, orange, etc.). Although depicted as being different colors in the drawings, in certain embodiments each of the core and sheath components 210, 220 can be the same color.

Furthermore, in certain embodiments the color of the core and/or sheath components 210, 220 of the multi-component bristle 200 can be used to indicate a flavor of that particular component or a trigeminal effect that will be imparted to the user by that particular component. Thus, for example, a multi-component bristle may include a core component that contains an orange flavored oral care additive and a sheath component that contains a lemon flavored oral care additive. In such an embodiment the core component may be orange in color and the sheath component may be yellow in color to visually communicate their respective flavors to a user. Similarly a multi-component bristle may include a core component that has a green tea extract and a sheath component that includes black pearl. In such an embodiment, the core component may be green in color and the sheath component may be black in color to visually communicate their respective oral care additives to a user. Similarly, the color blue can be used to inform a user that a particular component will provide a cooling trigeminal effect to the user, the color red can be used to inform a user that a particular component contains an oral care additive that will boost blood circulation, the color purple can be used to inform a user that a particular component contains an anti-inflammatory oral care additive, etc. Color-coding the strand components of the multi-component bristles provides a desirable visual aesthetic as well as being informative for the user or consumer. The oral can implement on which the multi-component bristles an contained may include a color-coded key on its handle, head, packaging or on a separate instruction/information sheet that is provided with the oral can implement to inform the user of the message that the various colored components are intended to convey.

In certain embodiments, any of one or more of the above oral can additives can be included into each of the core and sheath components 210, 220 that are used to form the multi-component bristle 200. However, in certain embodiments one of the above oral care additives is included into the core component 210 and a second one of the above oral care additives is included into the sheath component 220, the second one of the above oral care additives being different than the first one of the above oral care additives. In certain embodiments, the first and second oral can additives may each have an agent that is selected so that during brushing the agents of the first and second oral can additives mix together to form a third oral can additive or agent. Specifically, prior to brushing the first oral care additive will remain chemically isolated from the second oral care additive despite the first and second oral care additives being on the same multi-component bristle 200 because the first oral can additive is formed into or carried by the core component 210 and the second oral car additive is formed into or carried by the sheath component 220. During brushing, the core and sheath components 210, 220 will get wet, which enables the first oral care additive 212 (or a portion thereof) to be released from the core component 210 and the second oral care additive 222 (or a portion thereof) to be released from the sheath component 220. When the first and second oral care additives 212, 222 are simultaneously released, the agents within those oral care additives may intermix within the user's oral cavity to form a third agent in some embodiments.

Intermixing of the first and second oral car additives within the user's oral cavity can be beneficial in certain instances. Specifically, certain agents, medicaments, anesthetics, antimicrobial agents, polishes, whiteners and other miscellaneous agents, substances and chemicals lose effectiveness over time. Thus, it may be desirable to apply such substances substantially immediately after their formation. Using the core and sheath components 210, 220 of the multi-component bristle 200 as the structures on which the oral care additives are housed facilitates this intermixing within the user's oral cavity.

As noted above, the two oral care additives can be selected so that they form a third oral care additive or agent upon intermixing within a user's oral cavity. Some reactions that may occur include: (1) mixing a base with an acid to form a neutral; (2) mixing a base with a curing agent to form an epoxy resin; (3) mixing Bisphenol F with Epichchlorhydin to form diglycidyl ether of bisphenoal A (epoxy resin); (4) mixing calcium carbonate with hydrogen peroxide to form peroxide; (5) mixing water with hydrogen peroxide to form peroxide; (6) mixing potassium nitrate with stannous fluoride to form a sensitivity agent; (7) mixing chlorhexadine with silica to form an antimicrobial agent; (8) mixing cetylpyridinium chloride with silica to form an antimicrobial agent; (9) mixing tricolsan with pyrophosphate to form an antimicrobial agent, and (10) mixing a first flavor with a second flavor to form a third flavor. Thus, various oral care additives/agents can be formed that are known for tooth whitening, cleaning, antimicrobial, antibacterial, taste or other desired effects.

As noted above, the core component 210 is formed of the first plastic 211 and the sheath component 220 is formed of the second plastic 221. In certain embodiments, each of the first and second plastics 211, 221 is the same. In such embodiments, both of the first and second plastics 211, 221 may be erodible by an etchant or neither of the first and second plastics 211, 221 may be erodible by the etchant. However, in other embodiments the first and second plastics 211, 221 are different. In one particular embodiment, the first plastic 211 is erodible by an etchant and the second plastic 221 is chemically resistant by the etchant. Furthermore, in one embodiment the first plastic 211 is a polyester, such as polybutylene terephthalate (PBT), and the second plastic 221 is a polyamide, such as nylon. Of course, the invention is not to be limited by the particular materials that are used to form the core and sheath components 210, 220 unless so specified in the claims.

In the embodiment exemplified in FIGS. 2A-2C, both the core and sheath components 210, 220 of the multi-component bristle 200 are tapered. Specifically, the sheath component 220 has a tapered section 224 and the core component 210 has a tapered section 214. Thus, the tip portion 230 of the multi-component bristle 200 has a conical shape that decreases in transverse cross-sectional area moving from a transition point TP1 to the free end 202 of the multi-component bristle. In the exemplified embodiment, the transition point TP1 is the point on the multi-component bristle where the sheath component 220 begins to taper. Furthermore, the core component 210 begins to taper at the terminal end 203 of the sheath component 220. This is because, in certain embodiments, the core component 210 cannot taper between the terminal end 203 of the sheath component 220 and the base end 201 of the multi-component bristle 200 because the core component 210 is covered by the sheath component 220 in that area. Thus, in particular when chemical etching is used to taper the multi-component bristle 200, only the exposed second portion 216 of the core component 210 will be tapered.

In the exemplified embodiment, the taper is continuous from the transition point TP1 to the free end 202 of the multi-component bristle 200. Thus, the reduction in cross-sectional area from the transition point TP1 to the flee end 202 is constant and continuous, which results in a smooth transition between the sheath component 220 and the core component 210. In other words, the core component 210 begins to taper where the sheath component 220 ends so that there are no bumps, ridges, edges, points or grooves in the location between the core and sheath components 210, 220, but rather simply a smooth transition. State another way the transverse cross-sectional area of the sheath component 220 at the terminal end 203 of the sheath component 220 is identical to the cross-sectional area of the con component 210 at the terminal end 203 of the sheath component 220. Due to the core component 210 beginning to taper exactly at the terminal end 203 of the sheath component 220, the tip portion 230 of the multi-component bristle 200 has a continuos, uninterrupted taper despite being formed partially by the sheath component 220 and partially by the core component 210.

In the exemplified embodiment, the tip portion 230 of the multi-component bristle 200 is formed by the tapered section 214 of the core component 210 and the tapered section 224 of the sheath component 220. In the exemplified embodiment, the core component 210 forms a larger part of the tip portion 230 of the multi-component bristle 200 than the sheath component 220. Specifically in the exemplified embodiment the tapered section 214 of the core component 210 has a greater length than the tapered section 224 of the sheath component 220 (measured either vertically along the longitudinal axis A-A or measured along the outer boundary/outer surface of the multi-component bristle 200). However, the invention is not to be so limited in all embodiments and in certain other embodiments the core and sheath components 210, 220 can each form the same amount (i.e., percentage of the length) of the tip portion 230, or the sheath component 210, 220 can form a greater part of the tip portion 230 of the multi-component bristle 200 than the core component 210.

In the exemplified embodiment, each of the first and second plastics are formed of a polyester so as to be erodible by an etchant such that the conical shape of the tip portion 230 of the multi-component bristle 200 is formed by chemical etching. Thus, if the multi-component bristle 200 is placed into an etchant from the free end 202 to the transition point TP1 and slowly removed therefrom, the multi-component bristle 200 will taper from the transition point TP1 to the free end 202, and more specifically the sheath component 220 will taper from the transition point TP1 to the terminal end 203 of the sheath component 220 and the core component 210 will taper from the terminal end 203 of the sheath component 220 to the free end 202 of the multi-component bristle 200. In the exemplified embodiment the core component 210 has a constant transverse cross-sectional area from the base end 201 of the multi-component bristle 200 to the terminal end 203 of the sheath component 220 and the sheath component 220 has a constant transverse cross-sectional area from the base end 201 of the multi-component bristle 200 to the transition point TP1. Of course, other configurations are possible, such as varying transverse cross-sectional areas of each of the core and sheath components 220, 320 along the length of the multi-component bristle 200.

Of course, the invention is not to be so limited in all embodiments and in certain other embodiments the conical shape of the tip portion 230 can be formed by mechanical grinding or any other means. Regardless of the manner of creating the taper/conical shape, in the exemplified embodiment each of the core and sheath components 210, 220 comprise a tapered portion that collectively form the conical shape of the tip portion 230 of the multi-component bristle 200. Furthermore, in the exemplified embodiment, the flee end 202 of the multi-component bristle 200 is tapered to a tip or sharp point. Of course, the invention is not to be so limited in all embodiments and in certain other embodiments only the core component 210 may be tape red while the sheath component 220 is not tapered or only the sheath component 220 may be tapered while the core component 210 is not tapered. Furthermore, in still other embodiments the multi-component bristle 200 may be tapered, but still have a slightly rounded free end.

By having at least the second portion 216 of the core component 210 protrude from the sheath component 220, at least a portion of each of the core and sheath components 210, 220 is exposed and will contact a user's oral cavity during use of an oral care implement comprising the multi-component bristle 200. Therefore, the oral care additive 212 on the core component 210 will be able to be released into the user's oral cavity due to the second portion 216 being exposed. Thus, in certain embodiments only the second portion 216 of the core component 210 that is exposed and not covered or surrounded by the sheath component 220 may have an oral care additive thereon while the first portion 215 of the core component 210 is devoid or free of the oral care additive.

By having the core component 210 with the first oral cane additive 212 thereon protrude from the sheath component 220 so as to be exposed (both visibly and for direct contact with a user's oral cavity during use), a greater volume of the oral can additive 212 is able to be imparted to the user's oral cavity than would be possible if the core component 210 did not protrude from the sheath component 220. Specifically, without protruding from the sheath component 220, only the very top flat end surface of the core component 210 would contact a user's oral cavity during use, and only a very small amount of the oral care additive 212 would be released to the user's oral cavity. By extending the core component 210 a distance beyond the sheath component 220, a greater amount of the oral care additive 212 is able to be imparted onto the user's oral cavity to achieve desired benefits. Furthermore, tapering the ends of the multi-component bristle 200 enables a larger amount of the core component 210 to protrude from the sheath component 220 than would be possible with a rounded end, as seen in FIGS. 3A-3C and discussed directly below.

Figure 3A:
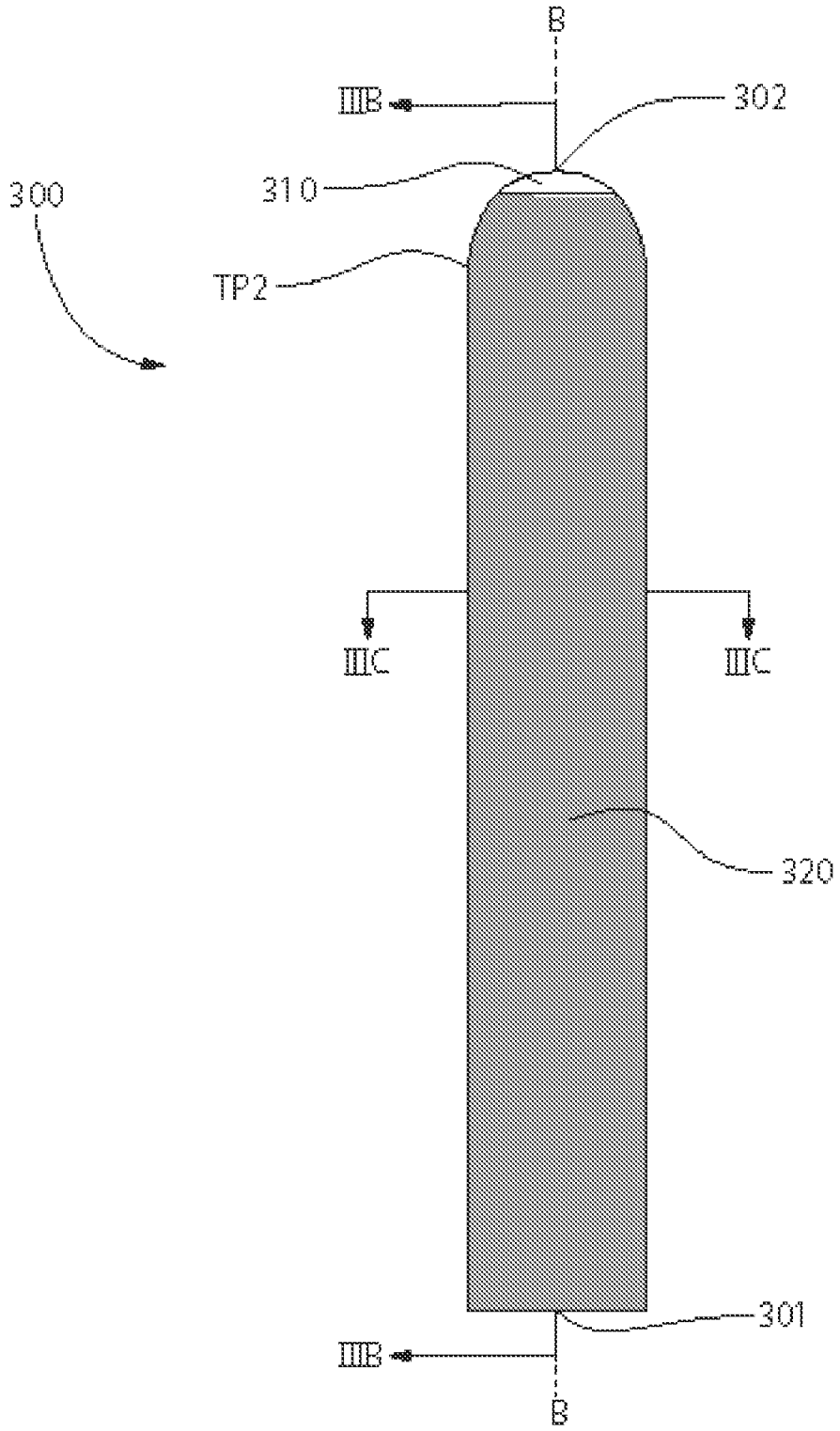
FIG. 3A is a front perspective view of a multi-component bristle in accordance with a second embodiment of the present invention.
Figure 3B:
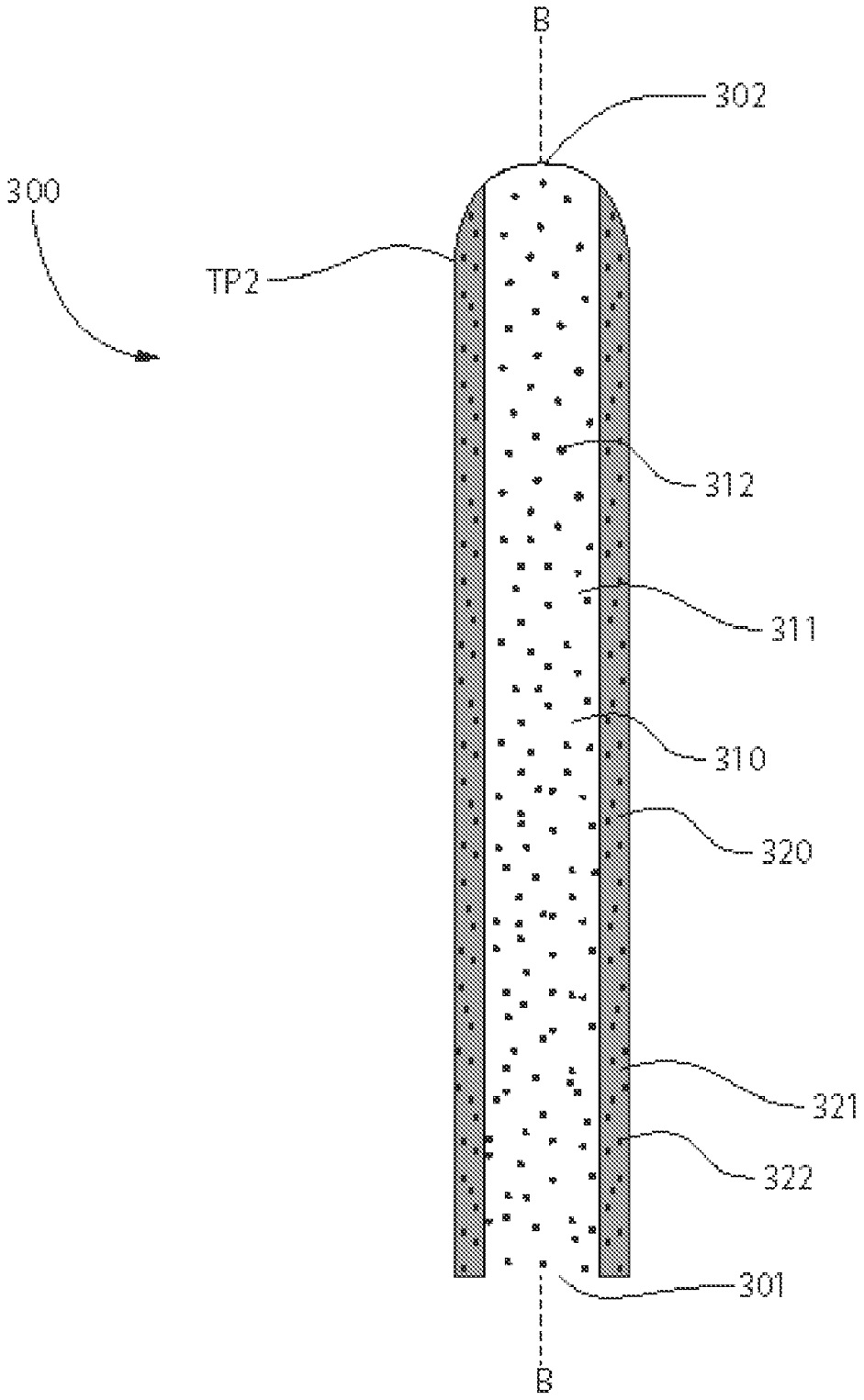
FIG. 3B is a cross-sectional view taken along line IIIB-IIIB in FIG. 3A
Figure 3C:
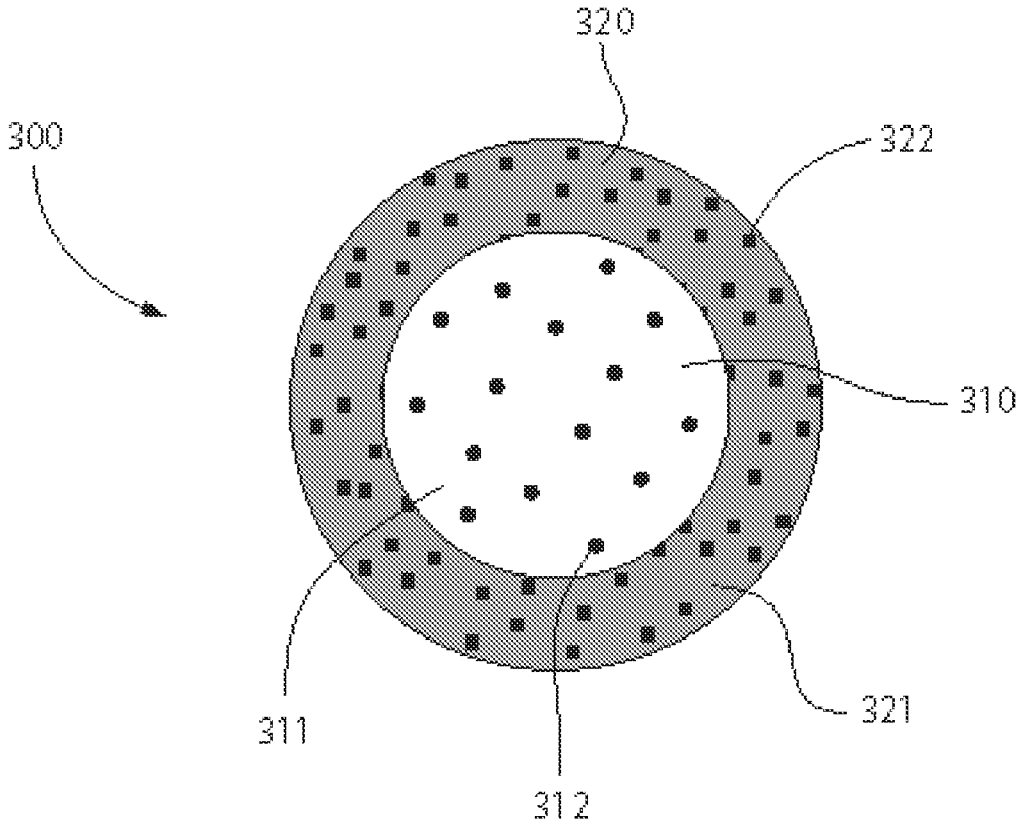
FIG. 3C is a cross-sectional view taken along line IIIC-IIIC in FIG. 3A.

Referring now to FIGS. 3A-3C, a multi-component bristle 300 is illustrated in accordance with another embodiment of the present invention. The multi-component bristle 300 extends from a base end 301 to a free end 302 along a longitudinal axis B-B. The multi-component bristle 300 comprises a core component 310 and a sheath component 320 that are coextruded together to form the multi-component bristle 300. The multi-component bristle 300 is similar to the multi-component bristle 200 except for the shape of the free end 302 of the multi-component bristle 300. Specifically, the core component 310 comprises a first plastic 311 and a first oral car additive 312 and the sheath component 320 comprises a second plastic 321 and a second oral care additive 322. The discussion of the first and second plastics 211, 221 and the first and second oral care additives 212, 222 above with regard to the multi-component bristle 200 is applicable to the multi-component bristle 300. Furthermore, the discussion of the different colors and the materials of the first and second plastics discussed above with regard to the multi-component bristle 200 are applicable to the multi-component bristle 300.

As noted above, the multi-component bristle 300 has a different shape at its free end 302 than the multi-component bristle 200. Specifically, the free end 302 of the multi-component bristle 300 is rounded rather than tapered. In the exemplified embodiment the multi-component bristle 300 begins to be rounded at a transition point TP2 such that a portion of each of the core and sheath components 310, 320 is rounded. Specifically the sheath component 320 is rounded from the transition point TP2 to the terminal end 303 of the sheath component 320 and the core component 310 is rounded from the terminal end 303 of the sheath component 320 to the flee end 302 of the multi-component bristle 300. The core component 310 has a constant transverse cross-sectional area from the base end 301 of the multi-component bristle 300 to the terminal end 303 of the sheath component 320 and the sheath component 320 has a constant transverse cross-sectional area from the base end 301 of the multi-component bristle 300 to the transition point TP2.

As a result of the co-extrusion process and the rounding of the free end 302, only a small portion of the core component 310 is exposed at the free end 302 of the multi-component bristle 300. In the exemplified embodiment, a large majority, such as between 90-99%, or between 92-98%, or between 94-96% of the length of the core component 310 is covered or surrounded by the sheath component 320. Of course, the invention is not to be so limited in all embodiments and more or less of the core component 310 can be exposed in certain other embodiments as desired.

Figure 4A:
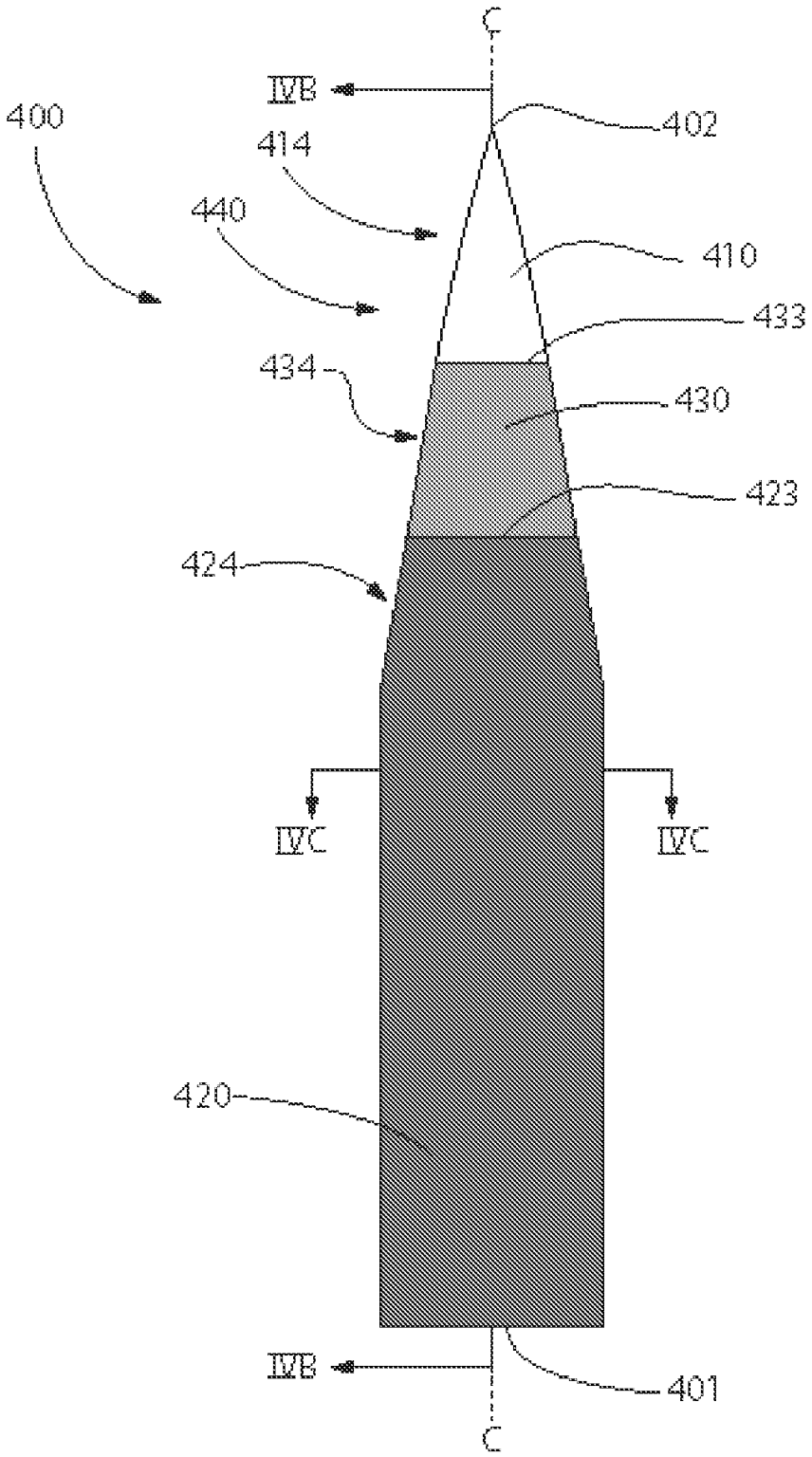
FIG. 4A is a front perspective view of a multi-component bristle in accordance with a third embodiment of the present invention.
Figure 4B:
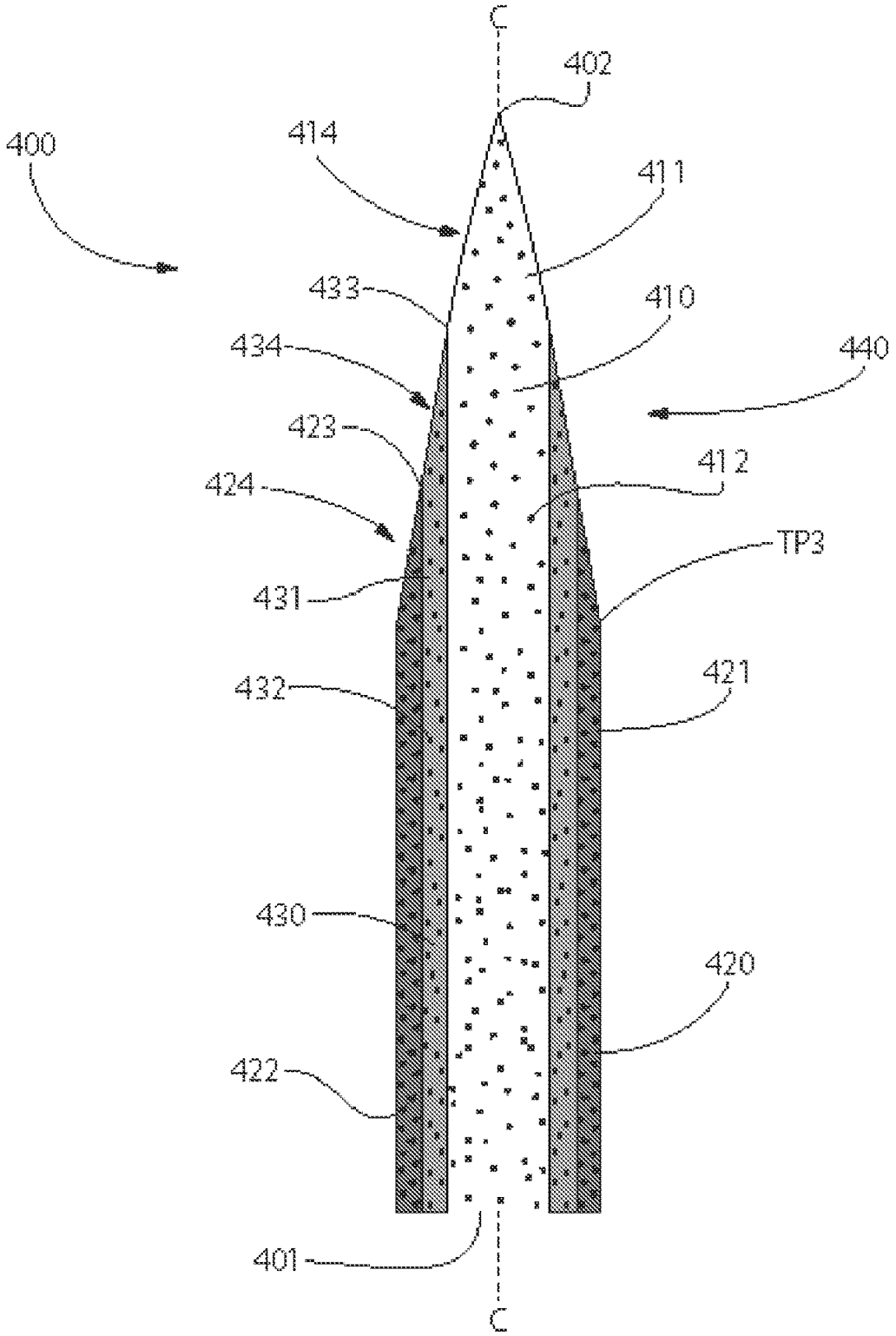
FIG. 4B is a cross-sectional view taken along line IVB-IVB of FIG. 4A.
Figure 4C:
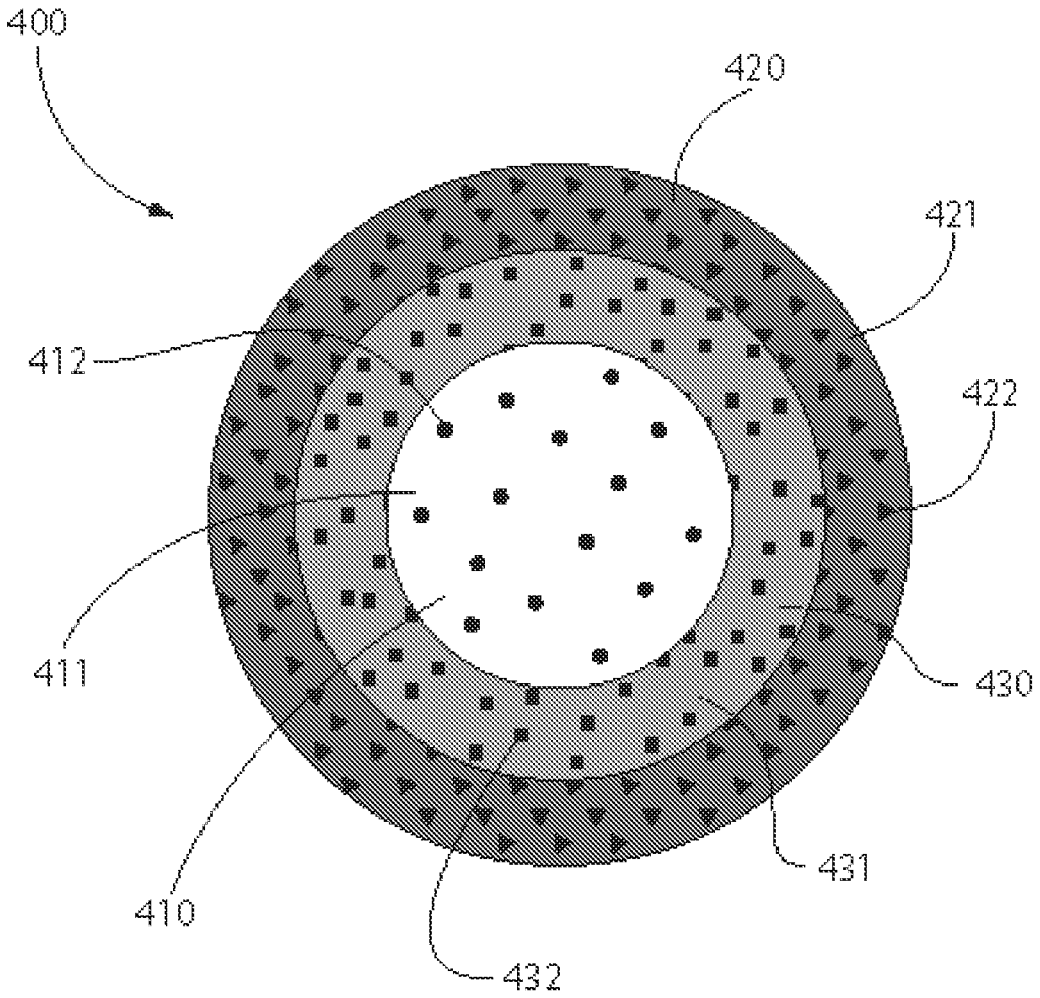
FIG. 4C is a cross-sectional view taken along line IVC-IVC of FIG. 4A.

Referring now to FIGS. 4A-4C, a multi-component bristle 400 is illustrated in accordance with another embodiment of the present invention. The multi-component bristle 400 comprises a core component 410, a sheath component 420 and an intermediary component 430. The intermediary component 430 is positioned between the core component 410 and the sheath component 420. Specifically the sheath component 420 surrounds a first portion of the intermediary component 430, a second portion of the intermediary component 430 protruding from the sheath component 420. Furthermore, the intermediary component 430 surrounds a first portion of the core component 410, a second portion of the core component 410 protruding through the intermediary component 430. In certain embodiments, the multi-component bristle 400 is formed by coextruding the core, sheath and intermediary components 410, 420, 430.

The core component 410 is formed of a first plastic 411 and comprises a first oral care additive 412. The sheath component 420 is formed of a second plastic 411 and comprises a second oral care additive 422. The intermediary component 430 is formed of a third plastic 431 and comprises a third oral care additive 432. Of course, the invention is not to be so limited in all embodiments and in certain other embodiments any one of the core, sheath and/or intermediary components 410, 420, 430 can be free of an oral care additive while the other of the core, sheath and/or intermediary components 410, 420, 430 comprises an oral care additive. In certain embodiments only one of the core, sheath, and intermediary components 410, 420, 430 comprises an oral care additive, in other embodiments two of the core, sheath and intermediary components 410, 420, 430 comprises an oral care additive, and in still other embodiments all three of the core, sheath and intermediary components 410, 420, 430 comprises an oral care additive.

In certain embodiments, each of the first, second and third plastics 411, 421, 431 can be the same, and in other embodiments each of the first, second and third plastics 411, 421, 431 can be different, and in still other embodiments two of the first, second and third plastics 411, 421, 431 can be the same while the other of the first, second and third plastics 411, 421, 431 is different. Furthermore, in certain embodiments each of the first, second and third oral can additives 412, 422, 432 can be a different oral can additive, such as any of the oral care additives discussed above with reference to the multi-component bristle 200. Any combination of different or the same oral care additives can be used on the various components of the multi-component bristle 400. All of the disclosure with regard to tapering, rounding, oral can additives, plastic materials, and colors discussed above with regard to the multi-component bristles 200, 300 are equally applicable to the multi-component bristle 400, although one specific embodiment of the multi-component bristle 400 will be de scribed herein below.

The multi-component bristle 400 extends from a base end 401 to a free end 402 along a longitudinal axis C-C. More specifically, the core component 410 of the multi-component bristle 400 extends from the base end 401 to the free end 402, the intermediary component 430 of the multi-component bristle 400 extends from the base end 401 to a terminal end 433 of the intermediary component 430, and the sheath component 420 of the multi-component bristle 400 extends from the base end 401 to a terminal end 423 of the sheath component 420. Furthermore, in the exemplified embodiment the core component 410 protrudes beyond the terminal end 433 of the intermediary component 430, and in the exemplified embodiment the corn component 410 tapers from the terminal end 433 of the intermediary component 430 to the free end 402 of the multi-component bristle 200. The intermediary component 430 protrudes beyond the terminal end 423 of the sheath component 420, and in the exemplified embodiment the intermediary component 430 tapers from the terminal end 423 of the sheath component 420 to the terminal end 433 of the intermediary component 430. The sheath component 420 tapers from a transition point TP3 to the terminal end 423 of the sheath component 420. As used herein, the term taper means that the transverse cross-sectional area of that component decreases from one point to another.

The taper of the multi-component bristle 400 is continuous in its decrease in cross-sectional area from the transition point TP3 to the free end 402 of the multi-component bristle 400. Specifically, the sheath component 410 tapers from the transition point TP3 to the terminal end 423 of the sheath component 410. The sheath component 410 has a first transverse cross-sectional area at the terminal end 423. The intermediary component 430 tapers from the terminal end 423 of the sheath component 420 to the terminal end 433 of the intermediary component 430. The intermediary component 430 has the first transverse cross-sectional area at the terminal end 423 and a second transverse cross-sectional area at the terminal end 433. Thus, when the intermediary component 430 begins to taper it has the same transverse cross-sectional area as when the sheath component 430 ends, thereby creating a continuous, smooth taper between the sheath and intermediary components 420, 430. Similarly, the core component 410 tapers from the terminal end 433 of the intermediary component 430 to the free end 402. The core component 410 has the second transverse cross-sectional area at the terminal end 433 that is the same as the transverse cross-sectional area of the intermediary component 430 at the terminal end 433. Thus, when the core component 410 begins to taper it has the same transverse cross-sectional area as when the intermediary component 430 ends, thereby creating a continuous, smooth taper between the intermediary and core component 430, 410.

From the base end 401 to the terminal end 423 of the sheath component 420 only the sheath component 420 is visible. From the terminal end 423 of the sheath component 420 to the terminal end 433 of the intermediary component 420 only the intermediary component 430 is visible. From the terminal end 433 of the intermediary component 430 to the free end 402 of the multi-component bristle 400 only the core component 410 is visible. Furthermore, the core component 410 has a substantially constant transverse cross-sectional area from the base end 401 to the terminal end 433 of the intermediary component 430, the intermediary component 430 has a substantially constant transverse cross-sectional area from the base end 401 to the terminal end 423 of the sheath component 420, and the sheath component 420 has a substantially constant transverse cross-sectional area from the base end 401 to the transition point TP3.

Thus, the con component 410 has a tapered section 414, the intermediary component 430 has a tapered section 434 and the sheath component 420 has a tapered section 424. In the exemplified embodiment, the length of the tapered section 414 of the con component 410 is greater than the length of the tapered section 434 of the intermediary component 430 aid the length of the tapered section 434 of the intermediary component 430 is greater than the length of the tapered section 424 of the sheath component 420. The ratio of the lengths of the tapered sections 424, 434, 414 is between 1.5:2:3 and 2.5:3:4, and morn specifically is approximately 2:2.5:3.5 The tapered sections 414, 434, 424 of the core component 410, the intermediary component 430 and the sheath component 420 collectively form a tapered portion 440 of the multi-component bristle 400, the tapered portion 440 of the multi-component bristle 400 having a conical shape that decreases in transverse cross-sectional area from the transition point TP3 to the free end 403 of the multi-component bristle 400.

As discussed above, in the exemplified embodiment each one of the core, intermediary and sheath components 410, 430, 420 comprises an oral care additive 412, 432, 422. In certain embodiments, any of one or more of the core, intermediary and sheath components 410, 430, 420 may be free of an oral care additive. Furthermore, the oral care additives 412, 432, 422 can be the same or different in different embodiments as desired. In the exemplified embodiment, at least a portion of each of the core component 410, the intermediary component 430 and the sheath component 420 is exposed both visibly from an exterior of the multi-component bristle 400 and for contact with a user's oral cavity during use of an oral can implement that contains the multi-component bristle 400. Thus, the benefits of each of the oral care additives 412, 432, 422 can be provided to the user's oral cavity using the multi-component bristle 400.

Although the multi-component bristle 400 is described herein as having three different components, the invention is not to be so limited and in other embodiments, four, five or more different components/layers can be used, each of which has a different oral care additive or any combination of the same and different oral care additives and lack thereof. Thus, using the inventive multi-component bristles described herein, an oral care implement can be created that can dispense/release many different oral can additives into a user's oral cavity simultaneously. A combination of different two component (or mole) multi-component bristles can be utilized on the same oral care implement head wherein each component has different oral care agents/additives. For example, an oral care implement may include tooth cleaning elements disposed in transverse rows on the head. Each transverse row may include bristle tufts including multi-component bristles in one transverse row include different oral care additives than the multi-component bristles in each other or each adjacent transverse row. A virtually unlimited number of different combinations of the multi-component bristles described herein are possible.

Furthermore, although the invention has been descried herein with regard to an oral care implement having at least one bristle tuft having at least one multi-component bristle, in certain embodiments the inventive concept described herein is the multi-component bristle itself. Thus, the invention can simply be a multi-component bristle including coextruded core and sheath components wherein the core component comprises a first plastic and a first oral care additive and the sheath component comprises a second plastic and a second oral can additive, the second oral care additive being different than the first oral care additive.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle;

at least one bristle tuft extending from the head, the at least one bristle tuft comprising at least one multi-component bristle comprising coextruded core and sheath components, the sheath component surrounding a first portion of the core component, and a second portion of the core component protruding from the sheath component at a tip portion of the multi-component bristle;

the sheath component comprising a first plastic and a first oral care additive;

the core component comprising a second plastic and a second oral care additive, wherein the first oral care additive is different than the second oral care additive;

wherein the first oral care additive is carried by a first carrier and the second oral care additive is carried by a second carrier; and wherein the first carrier has a higher melting temperature than the first plastic and the second carrier has a higher melting temperature than the second plastic.

2. The oral care implement according to claim 1 wherein each of the first and second plastics is erodible by an etchant.

3. The oral care implement according to claim 1 wherein the tip portion of the at least one multi-component bristle has a conical-shape that decreases in transverse cross-sectional area moving toward a free end of the at least one multi-component bristle.

4. The oral care implement according to claim 3 wherein each of the core and sheath components comprise a tapered portion that collectively form the conical-shape.

5. The oral care implement according to claim 1 wherein the first plastic is erodible by an etchant and the second plastic is chemically resistant against the etchant.

6. The oral care implement according to claim 5 wherein the first plastic is a polyester and the second plastic is a polyamide.

7. The oral care implement according to claim 1 wherein the first oral care additive is in the form of particles that are mixed into the first plastic; and wherein the second oral care additive is in the form of particles that are mixed into the second plastic.

8. The oral care implement according to claim 1 wherein the first oral care additive and the second oral care additive are releasable from the first and second plastics respectively.

9. The oral care implement according to claim 1 wherein each of the first and second carriers is water-soluble.

10. An oral care implement comprising:

a handle;

a head coupled to the handle;

at least one bristle tuft extending from the head, the at least one bristle tuft comprising at least one multi-component bristle comprising coextruded core and sheath components, the sheath component surrounding a first portion of the core component, and a second portion of the core component protruding from the sheath component at a tip portion of the multi-component bristle;

the sheath component comprising a first plastic;

the core component comprising a second plastic; and wherein one of the core and sheath components comprises an oral care additive and the other one of the core and sheath components is free of an oral care additive;

wherein the oral care additive is carried by a carrier; and wherein the carrier has a higher melting temperature than one of the first and second plastics.

11. The oral care implement according to claim 10 wherein the core component comprises the oral care additive and the sheath component is free of the oral care additive.

12. The oral care implement according to claim 10 wherein the sheath component comprises the oral care additive and the core component is free of the oral care additive.

13. The oral care implement according to claim 10 wherein the oral care additive is a charcoal powder.

14. A multi-component bristle comprising:

a core component;

a sheath component, the sheath component surrounding a first portion of the core component, and a second portion of the core component protruding from the sheath component at a tip portion of the multi-component bristle;

the sheath component comprising a first plastic and a first oral care additive; and the core component comprising a second plastic and a second oral care additive, wherein the first oral care additive is different than the second oral care additive;

wherein the first oral care additive is carried by a first carrier and the second oral care additive is carried by a second carrier; and wherein the first carrier has a higher melting temperature than the first plastic and the second carrier has a higher melting temperature than the second plastic.

15. The multi-component bristle according to claim 14 wherein the tip portion of the multi-component bristle has a conical shape that decreases in transverse cross-sectional area moving toward a free end.

16. The multi-component bristle according to claim 15 wherein each of the core and sheath component comprises a tapered portion that collectively form the conical-shape.

17. The multi-component bristle according to claim 15 wherein the conical-shape of the tip portion is formed by chemical etching or mechanical grinding.

18. The multi-component bristle according to claim 14 wherein the first plastic is erodible by an etchant and the second plastic is chemically resistant against the etchant.

19. The multi-component bristle according to claim 14 wherein the first oral care additive is in the form of particles that are mixed into the first plastic; and wherein the second oral care additive is in the form of particles that are mixed into the second plastic.

20. The multi-component bristle according to claim 14 wherein each of the first and second oral care additives are selected from a group consisting of a mixture of pine tree extract and salt, a tea leaf extract, a pearl powder, a nephrite powder, a charcoal powder, and an antibacterial material.

* * * * *